US012742585B2

(12) United States Patent
Exley et al.

(10) Patent No.: US 12,742,585 B2
(45) Date of Patent: Sep. 22, 2026

(54) LIQUID COOLED AIR COOLING APPARATUS

(71) Applicant: Ontel Products Corporation, Fairfield, NJ (US)

(72) Inventors: Ross Exley, Morristown, NJ (US); Matthew Romano, Maplewood, NJ (US); Scott Barlettano, Fairfield, NJ (US); Carlos Carrillo, Belleville, NJ (US)

(73) Assignee: Ontel Products Corporation, Fairfield, NJ (US)

( * ) Notice: Subject to any disclaimer, the term of this patent is extended or adjusted under 35 U.S.C. 154(b) by 218 days.

(21) Appl. No.: 18/773,120

(22) Filed: Jul. 15, 2024

(65) Prior Publication Data

US 2026/0016214 A1 Jan. 15, 2026

Related U.S. Application Data

(60) Provisional application No. 63/666,873, filed on Jul. 2, 2024.

(51) Int. Cl.
*F25D 17/06* (2006.01)
*F25D 11/00* (2006.01)

(52) U.S. Cl.
CPC ..... *F25D 17/067* (2013.01); *F25D 11/003* (2013.01)

(58) Field of Classification Search
CPC ..... F24F 1/02; F24F 2005/0025; F24F 5/0017
(Continued)

(56) References Cited

U.S. PATENT DOCUMENTS 3,961,496 A * 6/1976 Ku ..... F24F 5/0017 62/332
4,129,994 A * 12/1978 Ku ..... B60H 1/3235 62/185

(Continued)

FOREIGN PATENT DOCUMENTS

CN 102052737 A 5/2011
CN 110671771 A 1/2020

(Continued)

OTHER PUBLICATIONS

Patent Cooperation Treaty International Search Report and Written Opinion and Written Opinion of PCT International application No. PCT/US23/10277, Jun. 14, 2023.

(Continued)

*Primary Examiner* — Steve S Tanenbaum
(74) *Attorney, Agent, or Firm* — Dickinson Wright PLLC

(57) ABSTRACT

An air cooling apparatus includes a housing that defines at least one compartment. The at least one compartment is separated into a first chamber and a second chamber that are thermally insulated from one another. The second chamber is configured to hold a cooled liquid. The housing defines an air inlet and an air outlet into the first chamber. At least one fan is positioned in the first chamber and is configured to pull air into the first chamber through the inlet and to emit air from the first chamber out of the outlet. At least one radiator is positioned in the first chamber and is configured to receive the cooled liquid from the second chamber into the at least one radiator, and configured to pass the liquid back into the second chamber for cooling the air passing through the first chamber before being emitted out of the outlet.

20 Claims, 4 Drawing Sheets

(58) Field of Classification Search
USPC ..... 62/419
See application file for complete search history.

(56) References Cited

U.S. PATENT DOCUMENTS

| | | | | |
|---|---|---|---|---|
| 5,685,165 | A * | 11/1997 | Bigelow, Jr. | F24F 5/0017 62/457.2 |
| 5,762,129 | A * | 6/1998 | Elliott | F24F 5/0017 62/460 |
| 9,091,449 | B2 * | 7/2015 | Donaldson | F24F 5/0021 |
| 2006/0225453 | A1 * | 10/2006 | Martello | B60H 1/005 62/425 |
| 2011/0030413 | A1 * | 2/2011 | Heil | F24F 5/0017 62/407 |
| 2020/0173669 | A1 * | 6/2020 | Sophus | F24F 5/0017 |
| 2021/0076849 | A1 | 3/2021 | Takenaka et al. | |
| 2024/0142155 | A1 * | 5/2024 | Franklin, Jr. | F24F 5/0017 |

FOREIGN PATENT DOCUMENTS

| | | | |
|---|---|---|---|
| CN | 116624948 | | 8/2023 |
| FR | 2800156 | A1 | 4/2001 |
| GB | 2323659 | A | 9/1998 |
| KR | 10-0733870 | B1 | 7/2007 |
| WO | 2006030901 | A1 | 3/2006 |
| WO | 2021172882 | A1 | 9/2021 |
| WO | 2023133243 | A2 | 7/2023 |
| WO | 2023133243 | A3 | 7/2023 |

OTHER PUBLICATIONS

European Search Report for EP24191815.0 dated Jan. 24, 2025.

* cited by examiner

LIQUID COOLED AIR COOLING APPARATUS

CROSS REFERENCE TO RELATED APPLICATIONS

This utility patent application claims the benefit of and priority to U.S. provisional patent application Ser. No. 63/666,873, filed on Jul. 2, 2024, the entire disclosure of which is hereby incorporated by reference in their entireties.

FIELD OF THE DISCLOSURE

The present disclosure relates generally to air cooling apparatuses, such as personal air coolers.

BACKGROUND

Many types of personal air cooling devices are commonly used for delivering cool air to users. Some examples include fans, evaporative coolers, and refrigeration cycle-based air conditioners. While these air coolers fulfill their intended functions, they individually have certain limitations. For instance, fans lack a cooling element to actively lower air temperature, and refrigeration cycle-based air conditioners are large, heavy and draw significant power. There is a continued demand for enhancements to air cooling devices.

SUMMARY OF THE DISCLOSURE

This section provides a general summary of the present disclosure and is not a comprehensive disclosure of its full scope or all of its features, aspects, and objectives.

According to an aspect of the disclosure, an air cooling apparatus includes a housing that defines at least one compartment. The at least one compartment is separated into a first chamber and a second chamber that are thermally insulated from one another. The second chamber is configured to hold a cooled liquid. The housing defines an air inlet and an air outlet into the first chamber. At least one fan is positioned in the first chamber and is configured to pull air into the first chamber through the inlet and to emit air from the first chamber out of the outlet. At least one radiator is positioned in the first chamber and is configured to receive the cooled liquid from the second chamber into the at least one radiator, and configured to pass the liquid back into the second chamber for cooling the air passing through the first chamber before being emitted out of the outlet.

Accordingly, the subject air cooling apparatus provides a simple and effective means of cooling air as it passes through the top chamber before being delivered to a user. The air cooling apparatus is also inexpensive to operate and easily manageable by an operator.

BRIEF DESCRIPTION OF THE DRAWINGS

Other advantages of the present disclosure will be readily appreciated, as the same becomes better understood by reference to the following detailed description when considered in connection with the accompanying drawings wherein.

DESCRIPTION OF THE ENABLING EMBODIMENT

Figure 1:
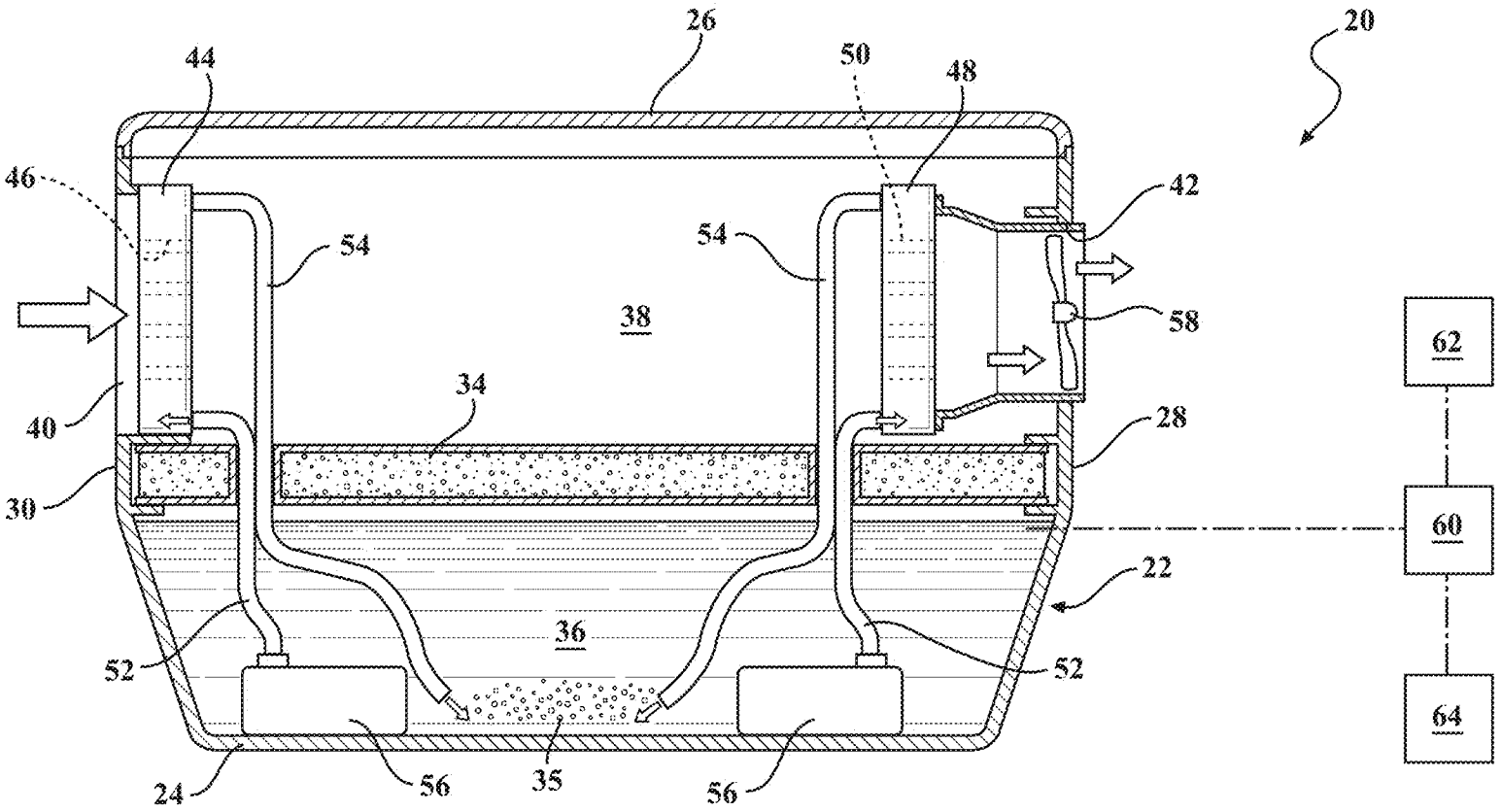
FIG. 1 is a cross-sectional, schematic view of a first embodiment of an air cooling apparatus, according to an aspect of the disclosure.
Figure 2:
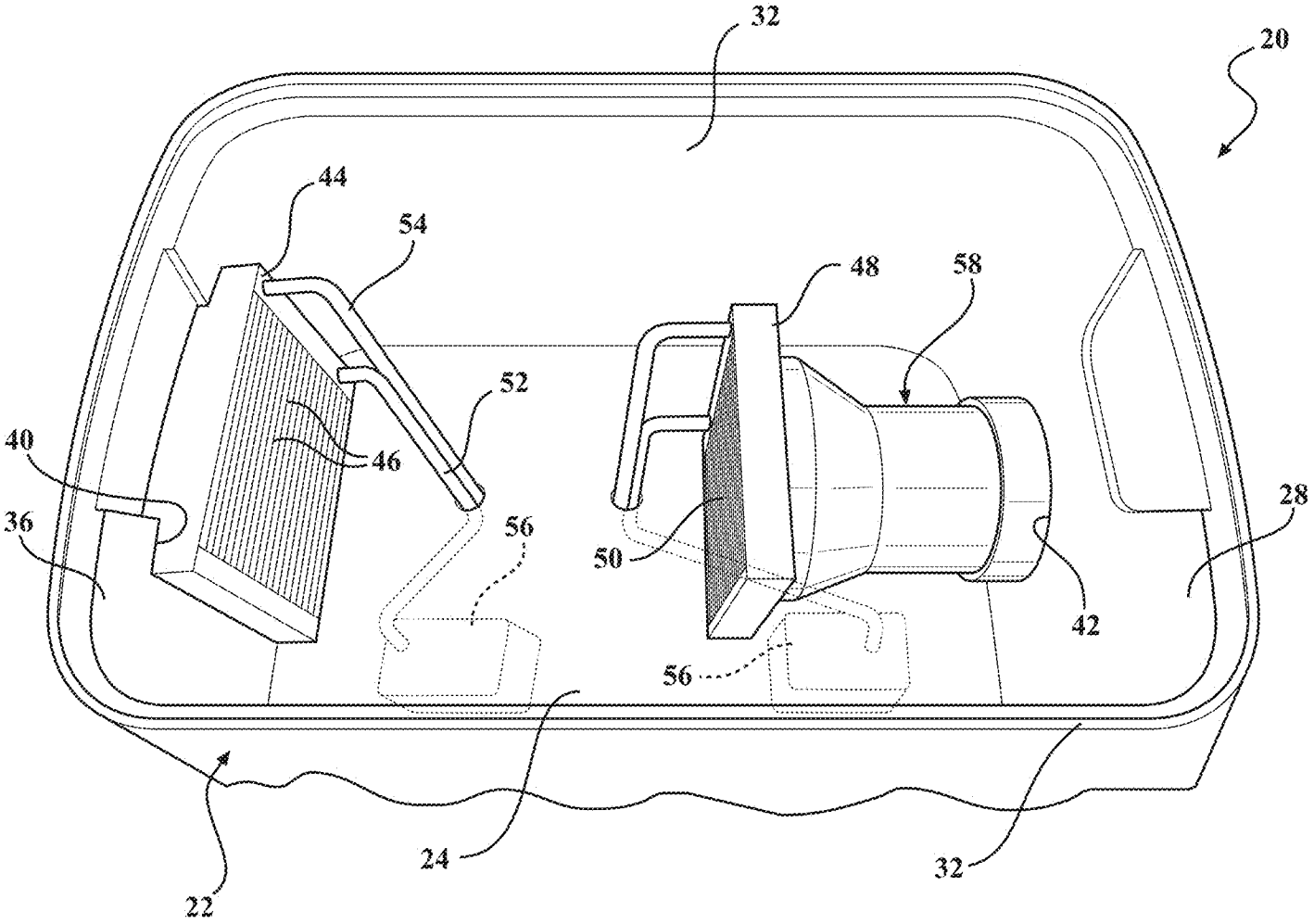
FIG. 2 is a top, perspective view of the first embodiment of the air cooling apparatus.
Figure 3:
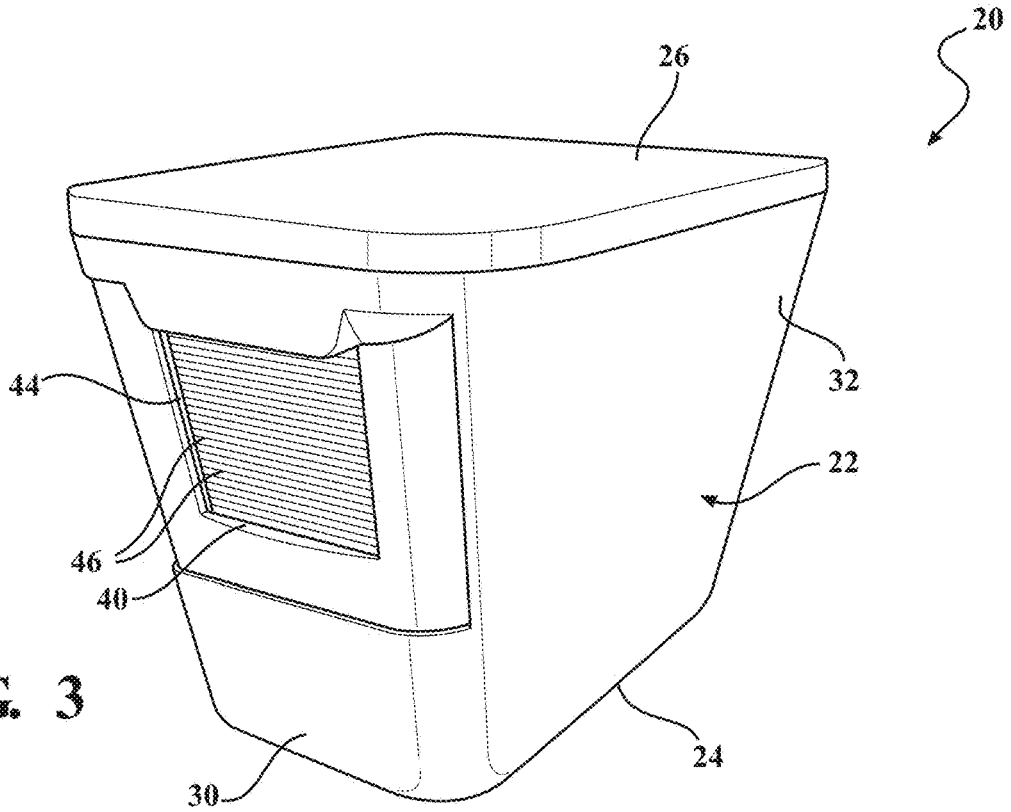
FIG. 3 is a rear, perspective view of the first embodiment of the air cooling apparatus.
Figure 4:
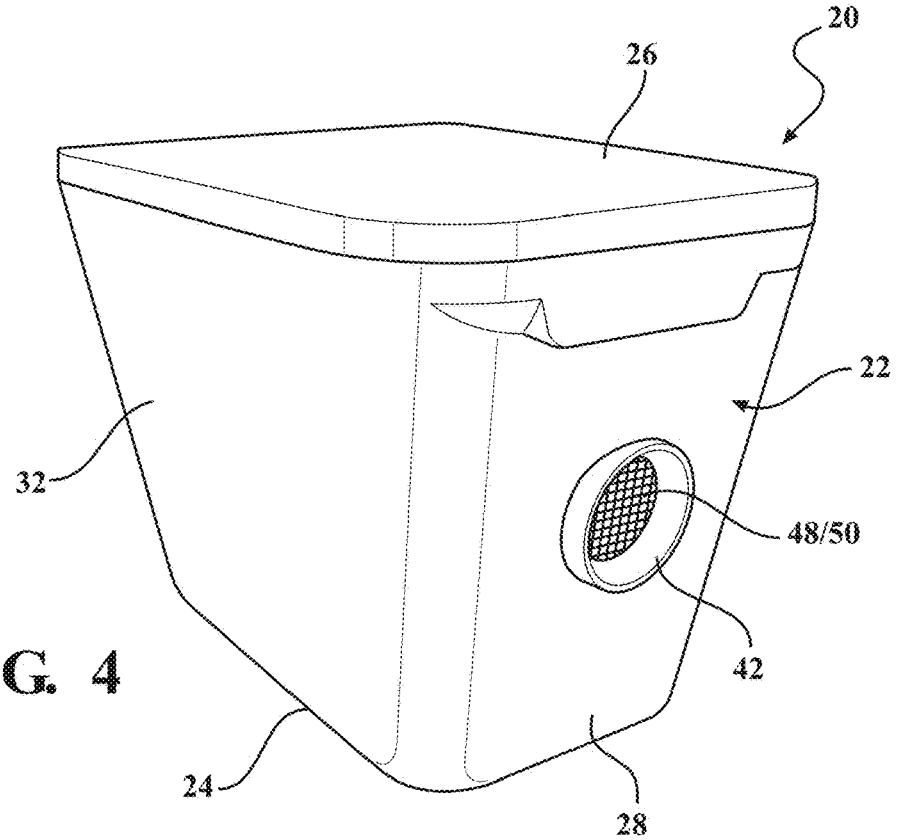
FIG. 4 is a front, perspective view of the first embodiment of the air cooling apparatus.

Referring to the figures, wherein like numerals indicate corresponding parts throughout the several views, embodiments of an air cooling apparatus 20, 200 are provided. The air cooling apparatus 20, 200 may be configured for personal use or may be scaled to any size for different environments.

A first embodiment of the air cooling apparatus 20 is shown in FIGS. 1-4. The air cooling apparatus 20 includes a housing 22 of a thermally insulating material that has a bottom wall 24, top wall 26, front wall 28, rear wall 30, and side walls 32. Examples of insulating materials include, but are not limited to, polyurethane foam, polystyrene foam, polyethylene, polypropylene and vacuum insulated panels. Together, the walls 24, 26, 28, 30, 32 define a compartment 36, 38. A divider 34 extends horizontally across the compartment 36, 38 and sealingly contacts the front, rear and side walls 28, 30, 32 to separate the compartment 36, 38 into a bottom chamber 36 and a top chamber 38. The bottom chamber 36 is between the bottom wall 24 of the housing 22 and the divider 34, and the top chamber 38 is between the divider 34 and the top wall 26. The divider 34 is also made of a thermally insulating material, like those described above, to minimize heat transfer between the top and bottom compartments 36, 38. As will be discussed in further detail, during use, the bottom chamber 36 is filled with cold and/or icy liquid 35, such as water. Because of the thermally insulating material of the walls 24, 26, 28, 30, 32 and divider 34, the bottom chamber 36 serves as a cooler for holding the cold liquid therein with minimal heat lost through the walls 24, 26, 28, 30, 32 and divider 34. The divider 34 may be removable to provide access to the bottom chamber 36, and/or one of the walls 24, 26, 28, 30, 32 of the housing 22 may have an opening and associated plug for permitting a user to selectively add liquid and/or ice to the bottom chamber 36.

The rear wall 30 defines an air inlet 40 into the top chamber 38, and the front wall 28 defines an air outlet 42 out of the top chamber 38. A first radiator 44 is positioned in the top chamber 38 in a manner in which it overlies the inlet 40. The first radiator 44 defines an array of inlet openings 46 to permit air to pass from the inlet 40 and through the first radiator 44 into the top chamber 38. Any number of inlet openings 46 may be used and they may be have various sizes and configurations. Likewise, a second radiator 48 is positioned in the top chamber 38 in a manner in which it overlies the outlet 42. The second radiator 48 defines an array of outlet openings 50 to permit air to pass from inside the top chamber 38, through the second radiator 48 and out of the outlet 42 to a user. As will be discussed in further detail below, the radiators 44, 48 are configured to draw heat from the air passing by the radiators 44, 48 to reduce a temperature of air exiting the top chamber 38 through the outlet 42 to the user. The presence of two radiators 44, 48 provides redundant cooling of the air both as it enters and exits the top chamber 38.

More particularly, the radiators 44, 48 are configured to draw cold liquid from the bottom chamber 36, run the cold liquid through the radiator 44, 48 and emit the liquid back into the bottom chamber 36. The radiators 44,48 thereby transfer heat from the top chamber 38 to the liquid, which is then directed to the bottom chamber 36 in order to cool the top chamber 38. More particularly, each of the radiators 44, 48 has an associated intake line 52 and an associated liquid output line 54. Each of the intake and output lines 52, 54 extends from its associated radiator 44, 48, through the divider 34, and into the bottom chamber 36. Each of the intake lines 52 is connected to a pump 56 for drawing cold liquid from the bottom chamber 36 and passing the liquid into the radiators 44, 48. After flowing through the radiators 44, 48, the liquid is passed back into the bottom chamber 36 via the output lines 54. In the disclosed embodiment, a respective pump 56 is connected to each intake line 52, but according to other embodiments, a single pump 56 may be used to charge both of the intake lines 52. The lines 52, 54 and pumps 56 may be lined with a thermally insulating material to minimize heat transfer away from the liquid conveyed therein.

As shown, a fan 58, or other air moving device, overlies the outlet 42 and is positioned between the front wall 28 and the second radiator 48. The fan 58 is configured to draw air into the top chamber 38 from the inlet 40, and to emit the air from the top chamber 38 through the outlet 42 after being cooled by the radiators 44, 48. According to other embodiments, more than one fan 58 could be used. Furthermore, the fan 58 could be located at other regions of the top chamber 38. For example, the fan 58 could located adjacent to the inlet 40 instead of the outlet 42 such that the fan 58 draws air through the inlet 40 and pushes the air out of the outlet 42.

According to other embodiments, additional radiators 44, 48 may be used, which may be located at various locations within the top chamber 38. For example, one or more radiators 44, 48 may be located toward a center of the top chamber 38. Furthermore, a single radiator 44, 48 could be located at either the inlet 40 or the outlet 42.

As schematically shown in FIG. 1, a power source 60 is connected to the pumps 56 and fan 58 for powering the pumps 56 and fan 58. Furthermore, one or more controllers 62 may be connected to the pumps 56 and/or fan 58 for adjusting a speed/flow rate of each. One or more input devices 64 such as buttons on the housing 22 or a smart phone may be electrically connected to the controller 62 for allowing an operator to make adjustments.

Figure 5:
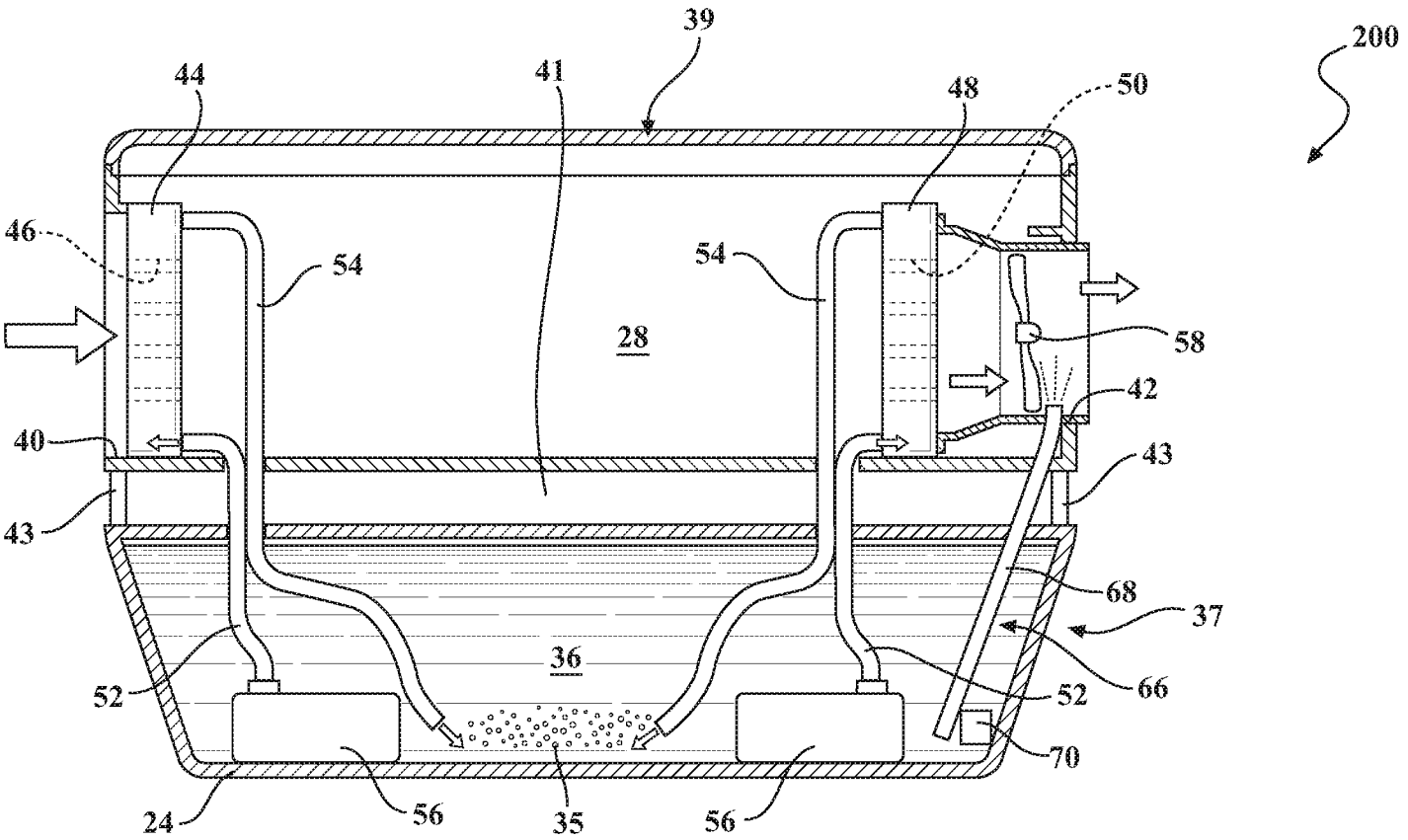
FIG. 5 is a cross-sectional, schematic view of a second embodiment of an air cooling apparatus, according to an aspect of the disclosure.

According to a second embodiment of the air cooling apparatus 200 shown in FIG. 5, instead of employing a divider to separate the top and bottom chambers 38, 36, the top and bottom chambers 38, 36 are defined by standalone top and bottom housing segments 39, 37 of the housing 22 which are separated from one another via a gap 41, e.g., an air gap 41. One or more spacers 43 are positioned between the top and bottom housings 39, 37 for connecting the top and bottom housings 39, 37.

Although the radiators 44, 48 of the disclosed embodiments are configured to circulate cold liquid from the bottom chamber 36 to provide the cooling effect, other types of cooling devices may be used. For example, Peltier modules like those shown in PCT International Application No. PCT/US2023/010277 (incorporated herein by reference in its entirety) to the Applicant could be used. Furthermore, as shown in FIG. 5, one or more misting mechanisms 66 may be positioned in front of the fan 58 to provide a cooling mist effect to the user. The misting mechanism 66 may include a tube 68 that extends between the lower and upper chambers 36, 28 and is configured to draw cooled liquid from the lower chamber 36 and emit aerated liquid in front of the fan 58 to provide the misting effect. The misting mechanism 66 may also include a mist pump 70 to propel the cooled liquid through the tube 68. Further examples of misting mechanisms that may be employed are shown in PCT/US2023/010277.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in that particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or later, or intervening element or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to described various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in any embodiment, even if not specifically shown or described. The same may also be varied in many ways. Such variations are not to be regarded as a departure from the disclosure, and all such modifications are intended to be included within the scope of the disclosure.

What is claimed is:

1. An air cooling apparatus, comprising:

a housing having a front wall and a rear wall in generally spaced and parallel relationship with the front wall, and defining at least one compartment;

the at least one compartment separated into a first chamber and a second chamber being thermally insulated from one another, wherein the second chamber is configured to hold a cooled liquid;

wherein a divider of a thermally insulating material extends substantially horizontally along a length of the divider between the front and rear walls of the housing and sealingly engages the front and rear walls and segments the compartment of the housing into the first chamber and the second chamber;

the housing defining an air inlet and an air outlet into the first chamber;

at least one fan positioned in the first chamber and configured to pull air into the first chamber through the inlet and to emit air from the first chamber out of the outlet; and at least one radiator positioned in the first chamber and configured to receive the cooled liquid from the second chamber into the at least one radiator, and configured to pass the liquid back into the second chamber for cooling the air passing through the first chamber before being emitted out of the outlet.

2. The air cooling apparatus as set forth in claim 1, wherein the at least one radiator overlies the inlet.

3. The air cooling apparatus as set forth in claim 1, further including at least one intake line extending from the at least one radiator into the second chamber for passing the cooled liquid from the second chamber to the at least one radiator; and at least one output line extending from the at least one radiator into the second chamber for passing the liquid from the at least one radiator back to the second chamber.

4. The air cooling apparatus as set forth in claim 3, further including at least one pump coupled to the intake line inside the second chamber, and configured to pump the cooled liquid from the second chamber to the radiator and out of the radiator through the output line.

5. The air cooling apparatus as set forth in claim 1, wherein the at least one radiator includes a first radiator and a second radiator.

6. The air cooling apparatus as set forth in claim 5, wherein the first radiator overlies the inlet and the second radiator overlies the outlet.

7. The air cooling apparatus as set forth in claim 6, wherein the at least one fan is positioned between the second radiator and the outlet.

8. The air cooling apparatus as set forth in claim 6, wherein the at least one fan is positioned between the first radiator and the inlet.

9. The air cooling apparatus as set forth in claim 5, further including a pair of intake lines each extending from one of the radiators into the second chamber for passing the cooled liquid from the second chamber to the radiator; and a pair of output lines each extending from one of the radiators into the second chamber for passing the liquid from the radiator back to the second chamber.

10. The air cooling apparatus as set forth in claim 9, wherein a pair of pumps are each positioned in the second chamber and connected to one of the intake lines for pumping the cooled liquid into the radiators and back to the second chamber.

11. The air cooling apparatus as set forth in claim 9, wherein a pump is connected to both of the intake lines for pumping the cooled liquid into the radiators and back to the second chamber.

12. An air cooling apparatus, comprising:

a housing defining at least one compartment;

the at least one compartment separated into a first chamber and a second chamber being thermally insulated from one another, wherein the second chamber is configured to hold a cooled liquid;

the housing defining an air inlet and an air outlet into the first chamber;

at least one fan positioned in the first chamber and configured to pull air into the first chamber through the inlet and to emit air from the first chamber out of the outlet; and at least one radiator positioned in the first chamber and configured to receive the cooled liquid from the second chamber into the at least one radiator, and configured to pass the liquid back into the second chamber for cooling the air passing through the first chamber before being emitted out of the outlet;

wherein the housing has a first housing segment defining the first chamber and a second housing segment defining the second chamber, and wherein the first and second housing segments are spaced from one another by a gap.

13. The air cooling apparatus as set forth in claim 12, wherein the first housing segment and the second housing segment are separated from one another by at least one spacer.

14. An air cooling apparatus, comprising:

a housing defining at least one compartment;

the at least one compartment separated into a first chamber and a second chamber being thermally insulated from one another, with the first chamber positioned above the second chamber, wherein the second chamber is configured to hold a cooled liquid;

the housing defining an air inlet and an air outlet into the first chamber;

at least one fan positioned in the first chamber and configured to pull air into the first chamber through the inlet and to emit air from the first chamber out of the outlet;

at least one radiator positioned in the first chamber and configured to receive the cooled liquid from the second chamber into the at least one radiator, and configured to pass the liquid back into the second chamber for cooling the air passing through the first chamber before being emitted out of the outlet;

the at least one radiator including a first radiator and a second radiator, wherein the first radiator overlies the inlet and the second radiator overlies the outlet;

at least one first intake line extending from the first radiator into the second chamber for passing the cooled liquid from the second chamber to the first radiator;

at least one first output line extending from the first radiator into the second chamber for passing the liquid from the first radiator back to the second chamber;

at least one second intake line extending from the second radiator into the second chamber for passing the cooled liquid from the second chamber to the second radiator; and at least one second output line extending from the second radiator into the second chamber for passing the liquid from the second radiator back to the second chamber.

15. The air cooling apparatus as set forth in claim 14, further including at least one pump coupled to the first and second intake lines inside the second chamber, and configured to pump the cooled liquid from the second chamber to the first and second radiators and out of the first and second radiators through the first and second output lines.

16. The air cooling apparatus as set forth in claim 14, wherein the at least one fan is positioned between the second radiator and the outlet.

17. The air cooling apparatus as set forth in claim 14, wherein the at least one fan is positioned between the first radiator and the inlet.

18. The air cooling apparatus as set forth in claim 14, wherein a divider of a thermally insulating material segments the compartment of the housing into the first chamber and the second chamber.

19. The air cooling apparatus as set forth in claim 18, wherein the housing has a front wall and a rear wall in spaced and parallel relationship with the front wall, wherein the divider extends in a horizontal direction along a length of the divider between the front and rear walls, and wherein the divider sealingly engages the front and rear walls to seal the first and second chambers from one another.

20. The air cooling apparatus as set forth in claim 19, wherein the first and second intake lines and the first and second output lines extend through the divider between the first and second chambers.

* * * * *